United States Patent [19]

Georgopoulos et al.

[11] Patent Number: 4,621,673

[45] Date of Patent: Nov. 11, 1986

[54] VENETIAN BLIND

[75] Inventors: George Georgopoulos, Pine Brook; Manuel Toledo, Union City; Jorge Teran, West New York, all of N.J.

[73] Assignee: Levolor Lorentzen, Inc., Lyndhurst, N.J.

[21] Appl. No.: 545,632

[22] Filed: Oct. 26, 1983

[51] Int. Cl.[4] ..... E06B 9/305; E06B 9/38

[52] U.S. Cl. ..... 160/168 R; 160/178 F; 160/176 R

[58] Field of Search ..... 160/166, 168 R, 170, 160/173, 174, 178 R, 319, 321, 176, 178 E, 178 F

[56] References Cited

U.S. PATENT DOCUMENTS

| | | | |
|---|---|---|---|
| 2,401,770 | 6/1946 | Nardulli | 160/170 |
| 2,579,144 | 12/1951 | Griesser | 160/170 |
| 2,579,485 | 12/1951 | Ferguson et al. | 160/173 X |
| 2,598,887 | 6/1952 | Burns | 160/170 |
| 4,143,699 | 3/1979 | Marotto | 160/176 R |
| 4,458,740 | 7/1984 | Anderson | 160/174 |
| 4,487,243 | 12/1984 | Debs | 160/168 R |

FOREIGN PATENT DOCUMENTS

| | | | |
|---|---|---|---|
| 154132 | 11/1953 | Australia | 160/173 |

*Primary Examiner*—Ramon S. Britts
*Assistant Examiner*—Cherney S. Lieberman

[57] ABSTRACT

A venetian blind having a clutch mechanism for controlling the tilt rod of the blind. The clutch mechanism is operated by a beaded cord. Lifting of the bottom rail and slats is accomplished by an extremely thin lift tape to be wound on a reel on the tilt rod. The top ends of the ladders of the blind are connected to a sled slidably mounted on the reel.

7 Claims, 23 Drawing Figures

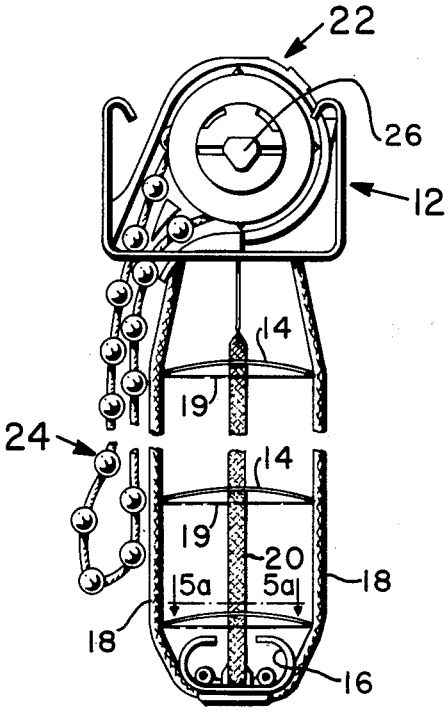
FIG.5
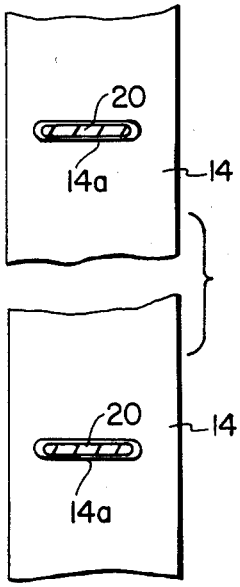
FIG.5a
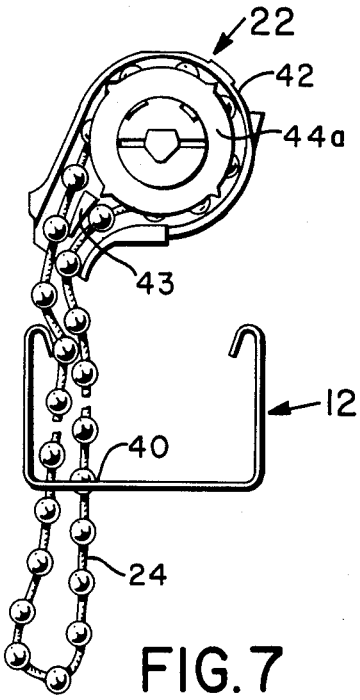
FIG.7
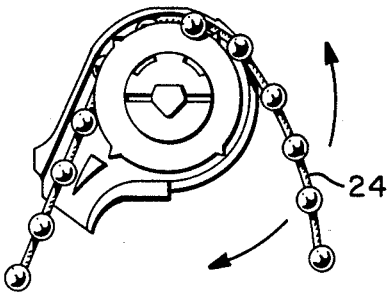
FIG.6
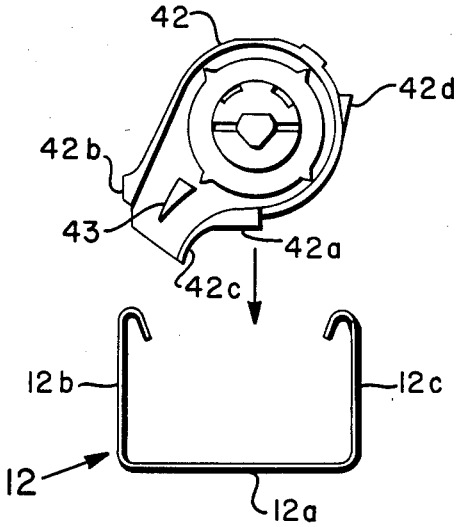
FIG.8
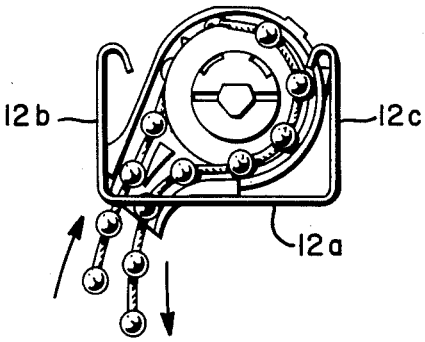
FIG.9a
FIG.9
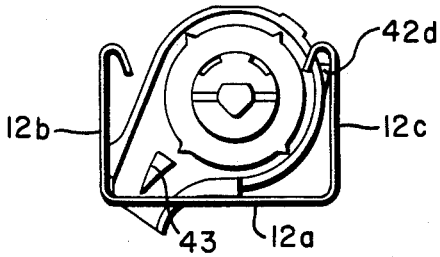

VENETIAN BLIND

BACKGROUND OF THE INVENTION

The present invention relates to venetian blinds, and more particularly to a venetian blind in which the lifting and lowering of the blind as well as the tilting of the blind slats is accomplished by one and the same clutch mechanism operated by a beaded chain.

It is an object of the invention to solve problems encountered with this type of blind.

More specifically, it is an object of the invention to avoid the problems encountered with the lift cords used in blinds of this type. They are difficult to wind up properly on a drum in the head of the blind, and it is almost impossible to insure that two or four of such lift cords wind up evenly on their respective drums. As a result, the bottom rail when it is lifted or lowered, does not stay horizontal.

SUMMARY OF THE INVENTION

This problem has been solved by using an extremely thin lift tape instead of a lift cord at each ladder location of the blind, and by providing a simple means for ensuring that the bottom rail will stay horizontal when lifted or lowered or that it can easily be put into a true horizontal position.

Other features of the invention will become evident from the following Specification.

BRIEF DESCRIPTION OF THE DRAWINGS

The invention is illustrated by way of example in the attached drawings, in which:

FIG. 5 is an end view of the venetian blind of FIGS. 1 and 2;

FIG. 5*a* is a section along line 5*a*—5*a* in FIG. 5;

FIG. 6 is an end view of a clutch mechanism used in the venetian blind according to the invention, and illustrates how a beaded cord for controlling the clutch mechanism is placed around the same;

FIG. 7 is an end view of a clutch mechanism and of the venetian blind head, and illustrates how the clutch mechanism is inserted into the venetian blind head;

FIGS. 8 and 9 are end views similar to that of FIG. 7, but without the beaded cord, and illustrate further steps in the insertion of the clutch mechanism into the venetian blind head to its final position;

FIG. 9*a* is the same as FIG. 9, but with the beaded cord;

DETAILED DESCRIPTION OF A PREFERRED EMBODIMENT

Figure 2:
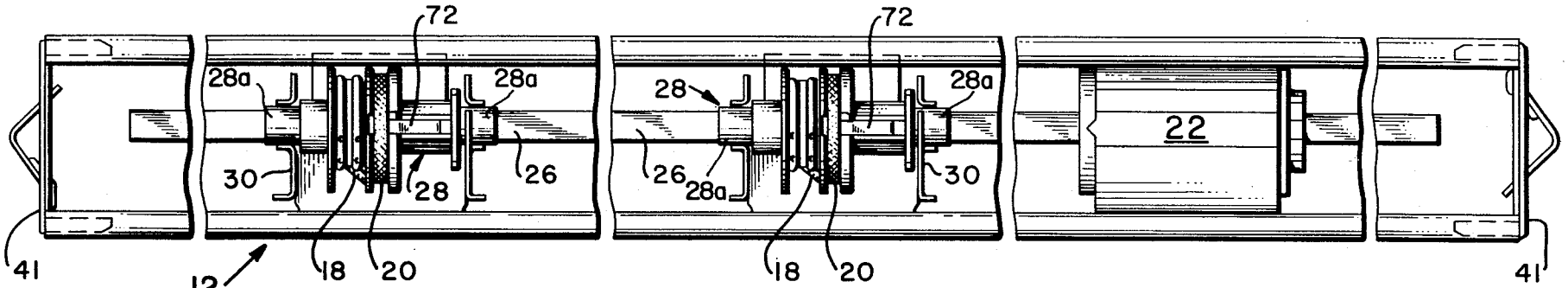
FIG. 2 is a top view of the venetian blind of FIG. 1.
Figure 1:
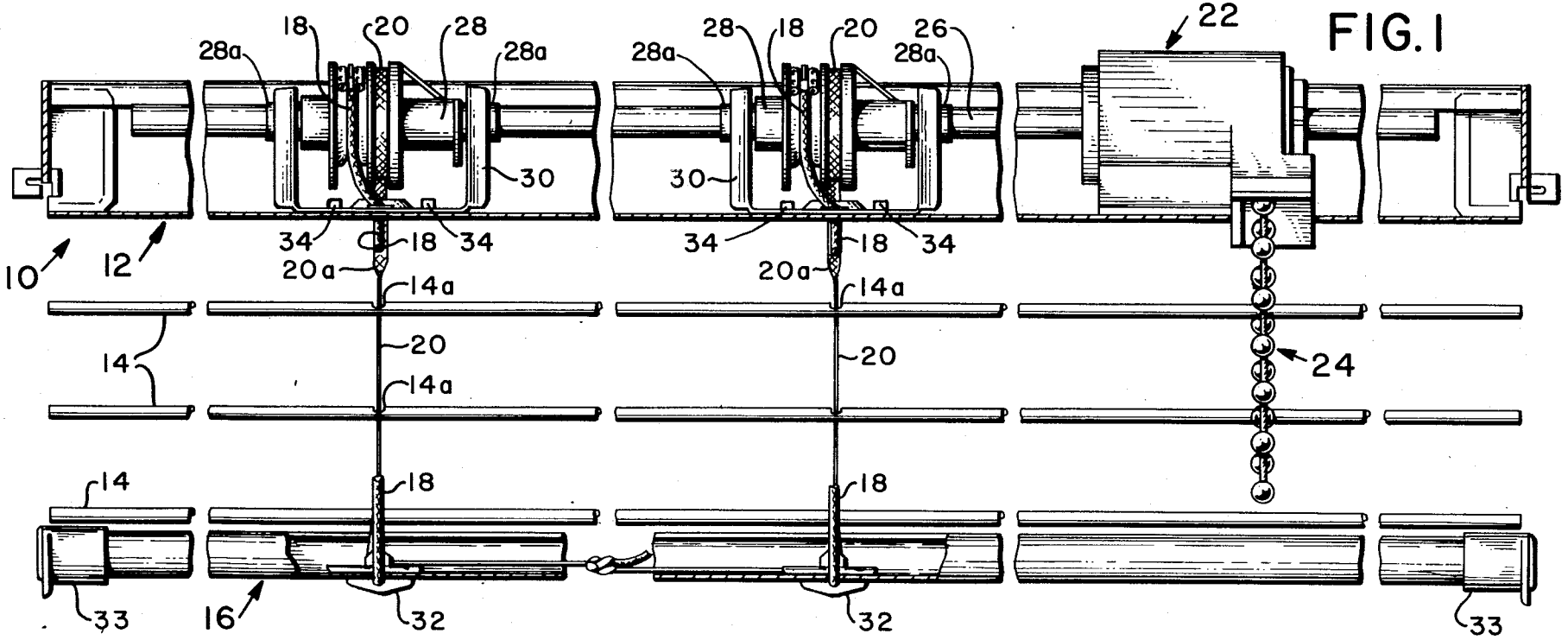
FIG. 1 is a front view of a venetian blind, partially in section, designed in accordance with the present invention.

Referring now to the drawings in detail, FIGS. 1 and 2 are respectively a front and top view of the venetian blind according to the present invention. The venetian blind, generally designated with reference numeral 10, comprises a head rail 12 from which are suspended a plurality of slats 14, only three of which are shown in FIG. 1, and a bottom rail 16, by means of ladders 18 with rungs 19 and a lift tape 20. The operation of the venetian blind, including lifting and lowering of the bottom rail and slats and tilting of the slats by means of the ladders 18, is accomplished by a control mechanism generally designated with the reference numeral 22. This control mechanism is a clutch, to be described later, which in turn is controlled by a beaded cord 24. Pulling of the beaded cord 24 in one direction or the other will in turn rotate a tilt rod 26 which carries drums 28 which in turn are rotatably supported in cradles 30 in the head rail. The upper ends of ladders 18 and the upper end of the lift tape 20 are supported in drum 28. There may be one, two or more pairs of drums 28 and associated cradles, lift tapes and ladders. The lower ends of ladders 18 and lift tape 20 pass through a bottom or ladder cap 32. The ends of this bottom rail are closed by end caps 33.

Figure 4:
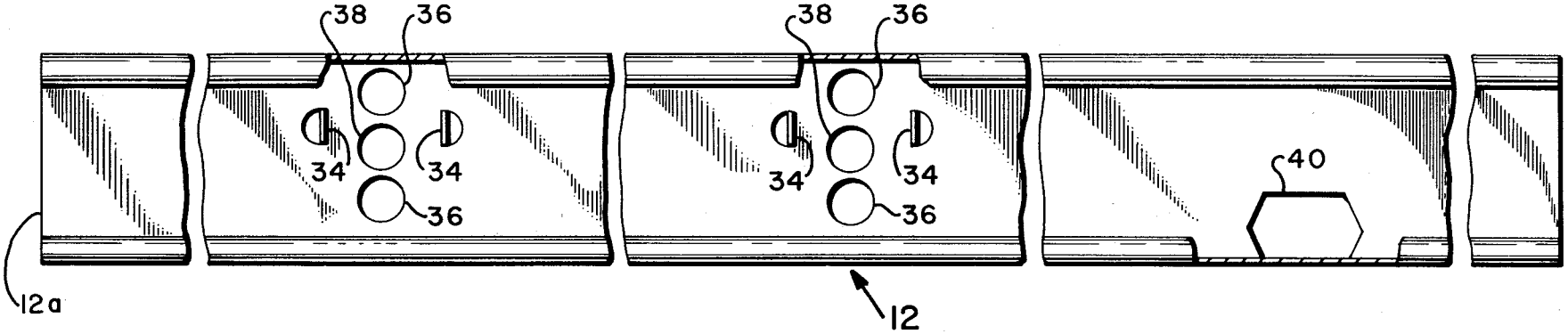
FIG. 4 is a top view of the head rail, partially in section.
Figure 3:
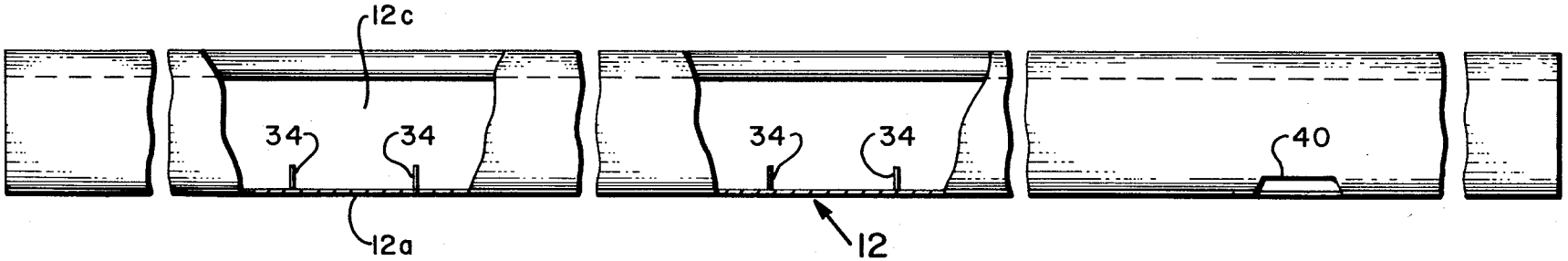
FIG. 3 is a front view, partially in section, of the head rail of the venetian blind of FIGS. 1 and 2.

The head rail per se is illustrated in FIGS. 3 and 4, without the elements located therein. As can be seen from FIGS. 3 and 4, for each location of a ladder and lift tape, there are provided tabs 34 which are punched out from the bottom 12*a* of the head rail and project upwardly into the interior of the head rail. Tabs 34 are later on bent sideways (see FIG. 2) to fix the position of the respective cradle 30 within the head rail. The head rail 12 is also provided with two passages 36 for the ladders 18 and with a passage 38 for the respective lift tape. The head rail is also provided with a passage 40 for receiving a portion of the control clutch mechanism 22. Opposite ends of the head rail are closed by end brackets 41 (FIGS. 1 and 2).

Figure 10:
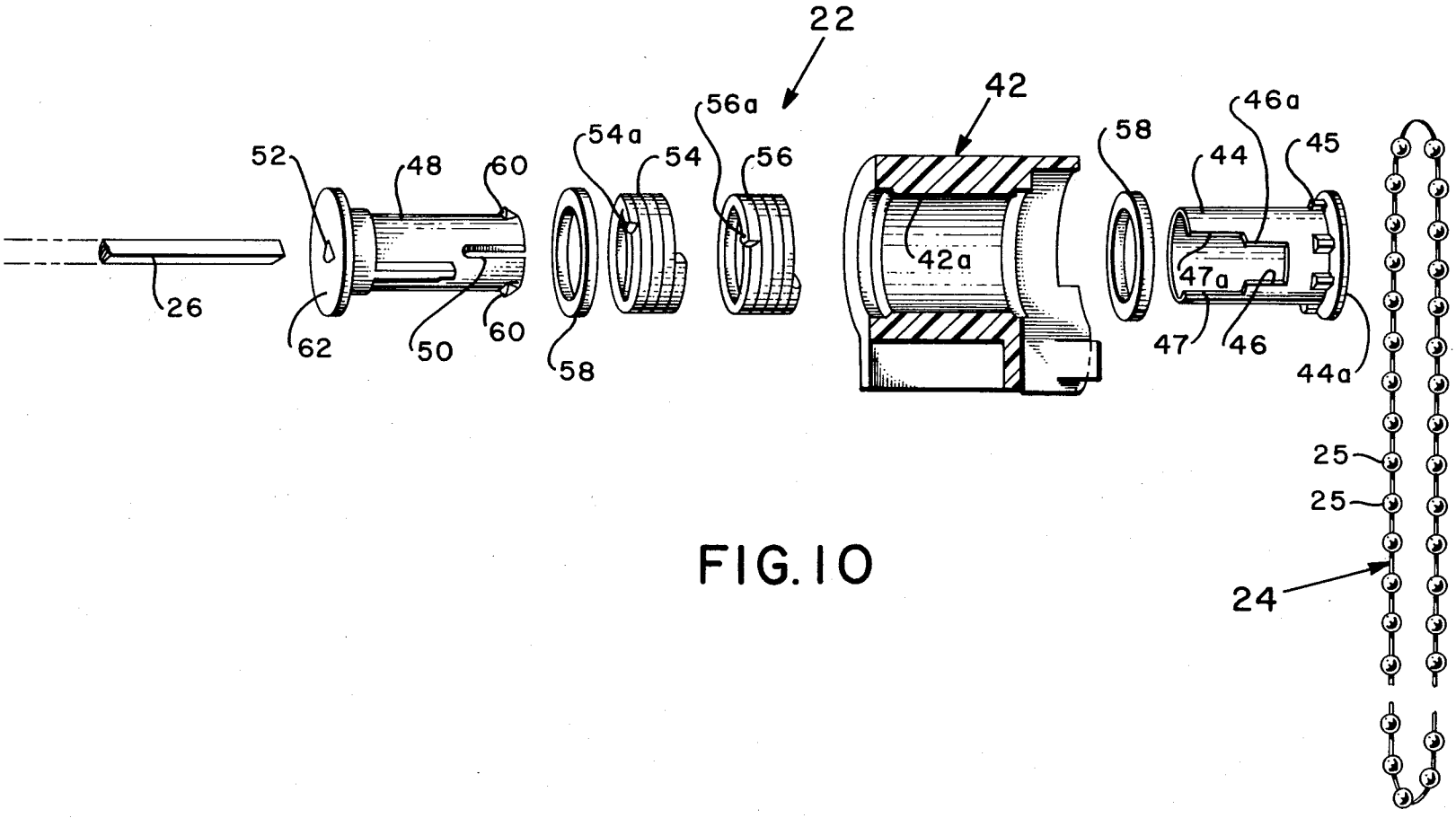
FIG. 10 is an exploded perspective view of the clutch mechanism of FIGS. 6 to 9.

The details of the clutch mechanism are illustrated in the exploded perspective view of FIG. 10. The clutch mechanism 22 includes a housing 42, a drum 44 with external stop 46, and a tilt rod drive element 48 with an internal stop 50. The drive element has an approximately D-shaped passage 52 for receiving the tilt rod 26. The clutch mechanism also includes two springs 54 and 56 and two rings 58.

The structure of the clutch mechanism per se is not to be considered part of the present invention. It is the subject of a patent application by an entity other than the present inventors. It has been illustrated here to complete the structure and be able to explain the operation of the venetian blind. Pulling on the beaded cord 24 in one direction will rotate the pulley 44 by means of the protrusions or "teeth" 45 on the pulley. One of the external stops 46, 47 of drum 44 presses against a finger 54*a*, 56*a* of each spring 54, 56 respectively. This action tends to wind or compress the springs, thereby reducing their friction with the wall 42*a* in housing 42. The same external stop 46, 47 contacts the internal stop 50 of the tilt rod drive 48 which in turn will revolve the tilt rod 26. The revolving tilt rod will rotate the drums 28 to wind up the tape 20 at each cradle location which in turn will raise the bottom rail 16 and slats 14. As the blind is raised the accumulated slats 14 will increase the load, and consequently the force to pull the beaded cord must be increased. Upon raising the blind to the desired height, the beaded cord 24 can be released. The load of the slats of the blind exerts a force tending to unwind the band 20 by pulling on the drum 48 which in turn begins to rotate the tilt rod 26 in the opposite direction. Reversal of tilt rod 26 in the opposite direction in turn will reverse the rotation of tilt rod drive element 48. The opposite internal stop 50 presses against the opposite edge of the same finger of each spring 54, 56 initially pushed by the external stop 46, 47 of pulley 44. In this direction, springs 54, 56 are being unwound, but because of their confinement in spring chamber 42*a* they expand and increase the friction against housing 42 to retard the descent of the slats or to hold the blind in that position.

To lower the blind, the beaded cord 24 is pulled in the opposite direction from that for lifting. Thus the opposite external stop 46*a*, 47*a* presses against the finger 56*a*, 54*a* on the springs, which action compresses the springs thereby reducing the friction against chamber wall 42*a* permitting the weight of the slats to assist in lowering the blind. The blind cannot fall or race ahead because the internal stop will cause a braking action to occur against the chamber 42*a* of housing 42. It would be sufficient to have one spring. However, two springs are utilized to provide a smoother lifting and lowering action. The lock 60 at the end of tilt rod drive element 48 protrudes through the hole in pulley 44. This pulley at one end and the cap 62 at the other end of tilt rod drive element 48 hold the assembly together in housing 42.

The assembled drive 22 is inserted in the manner illustrated in FIGS. 6 to 9. First, the beaded cord 24 is placed over the end cap 44*a* of pulley 44 and between cap 44*a* and housing 42, so that individual beads 25 come to rest between two adjacent stops 45 on the drum. A wedge-shaped protrusion 43 separates the two trains of the cord 24 to prevent them from becoming entangled. Thereafter, the beaded cord 24 is passed through passage 40 in head rail 12 and then the clutch mechanism 22 is passed into the head rail until it reaches the position illustrated in FIG. 9. To properly fix the location of the clutch mechanism 22 in head rail 12 housing 42 is provided with a bottom ledge 42*a* which comes to rest against bottom wall 12*a* of the head, a ledge 42*b* which comes to rest against the front wall 12*b* of the head. The housing is also provided with a lip 42*c* extending through passage 40, and a ledge 42*d* which comes to rest against the back wall 12*c* of head rail 12.

Figure 11:
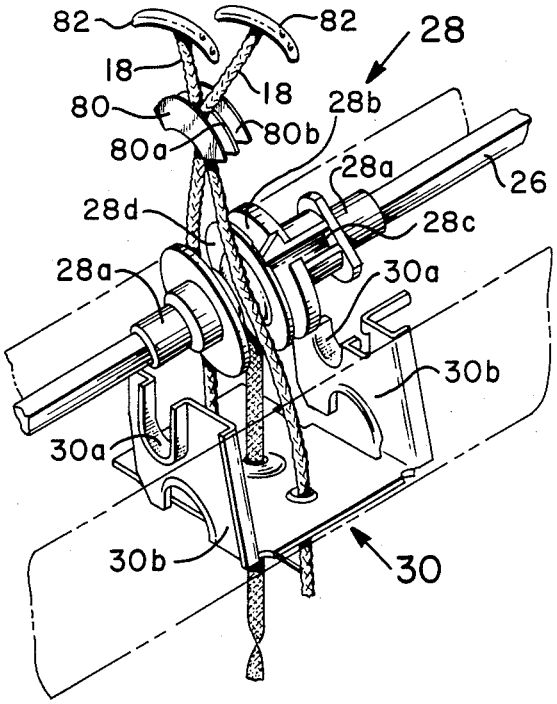
FIG. 11 is a perspective view of a cradle and drum, and further elements for connecting a lift tape and ladders to the drum.
Figure 12:
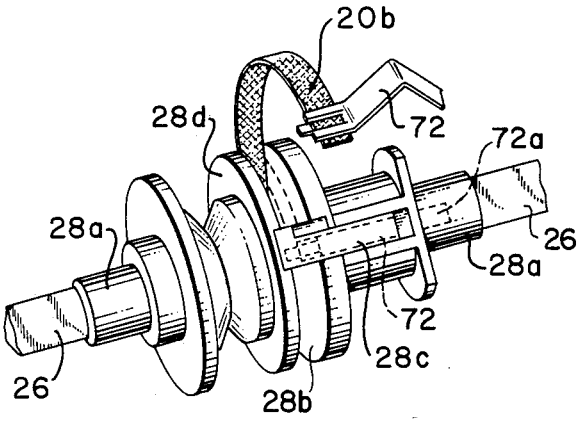
FIG. 12 is a perspective view showing in greater detail the connection of the lift tape to the drum.
Figure 14:
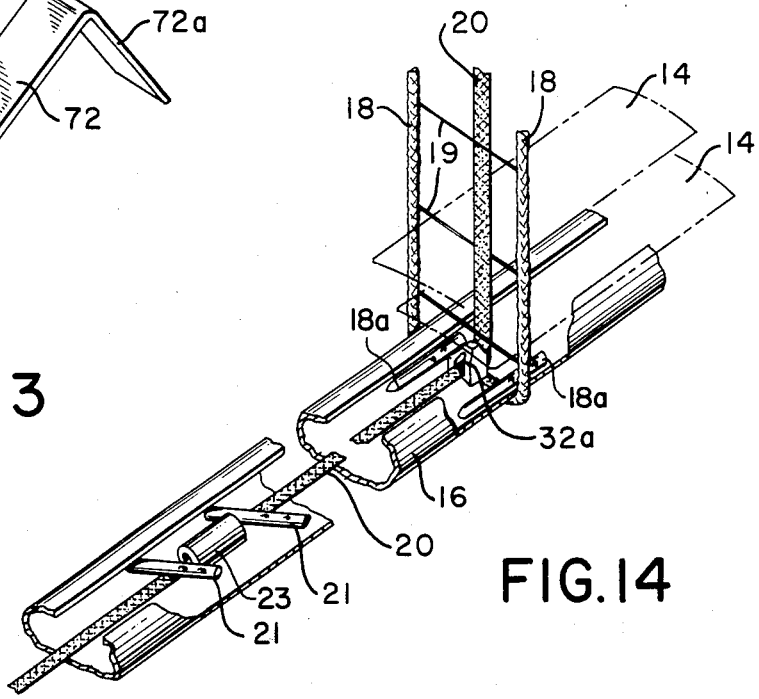
FIG. 14 is a perspective view of a bottom rail of the venetial blind, partially in section, and showing the connection of the tape and ladders to the bottom rail.
Figure 14A:
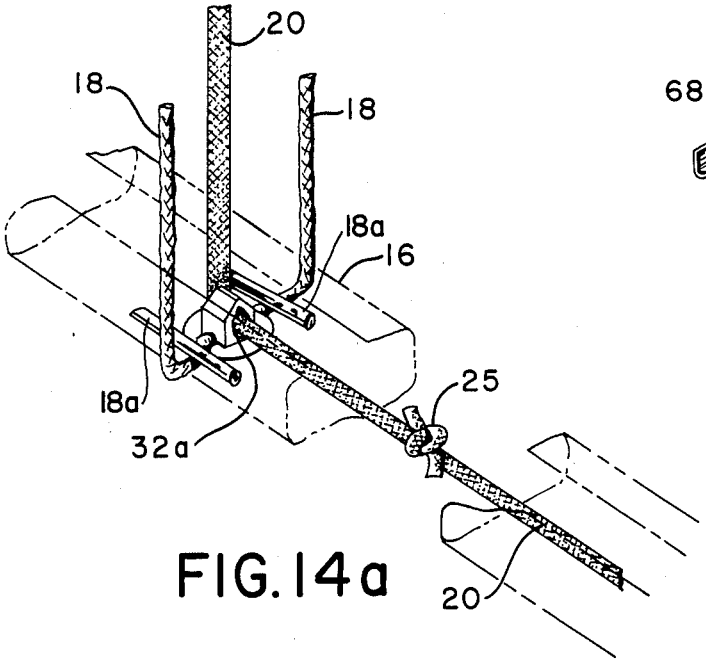
FIG. 14*a* is a view similar to that of FIG. 14 of an alternative embodiment.

One of the main features of the present invention is the lift tape 20, the means for winding up the lift tape on the drum 28, and the fastening of the lift tape to the bottom rail 16. The tape drum 28 is more clearly shown in FIGS. 11 and 12. It comprises two hubs 28*a* respectively supported in bearing portions 30*a* of side walls 30*b* of cradle 30. Drum 28 also comprises a reel portion 28*d* on which to wind up, by over-lapping turns, the tape 20. Tape 20 forms a very narrow and extremely thin woven plastic band. Depending on the width of the venetian blind two or four bands 20 are required. The bottom ends of two adjacent bands are passed through passages 32*a* of ladder caps 32 and joined together inside the bottom rail 16 as shown in FIGS. 14 and 14*a*, either by barbs 21 connected to the bottom ends and passed through a sleeve 23, or by simply making a knot 25. This makes it possible to always adjust the bottom rail 16 to a level position should one or the other band slip or wind unevenly on the reel portion 28*b* or if the bottom rail should encounter an obstacle when being raised or lowered. The adjustment can be made manually by pulling down on the higher end or automatically when the bottom rail and the bundle of slats 14 pushes against the blind head 12, as the blind is pulled to the fully raised position. Any pulling force greater than required to equalize the bottom rail will cause the clutch mechanism 22 to slip, thereby protecting the blind from damage.

The bottom ends of the bands 20 could be tied directly to the bottom rail as are all cords in conventional venetian blinds. However, to tie these bottom ends so that they are all of equal length would be almost impossible to do with any amount of accuracy and therefore the above mentioned manner of connection has been chosen. The bottom ends of ladders 18 pass around bottom rail 16, through passages 32*a* in ladder cap 32, and through passage 16*a* in bottom rail 16. Finally barbs 18*a* prevent the ladders from being pulled out of rail 16.

Figure 13:
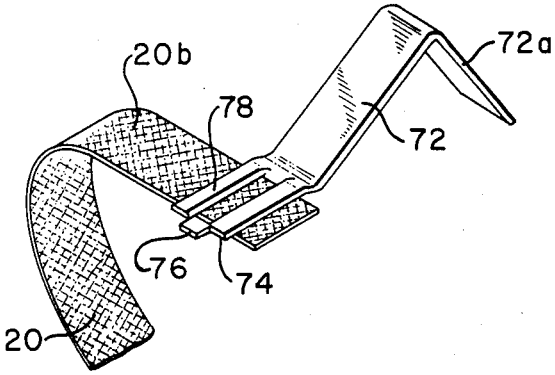
FIG. 13 is a perspective view of a part of the tape and the element for holding the tape to the drum, in still greater detail than in FIG. 12.

The bands 20 run through the slats 14 with their narrow sides parallel to each other and transverse to the longitudinal extension of the slats. This makes it possible to provide very narrow slots 14*a* in the slats 14. Thus, with the edge of each band toward the observer of the blind the band is almost invisible. The thickness of the band is approximately 0.007 inches. The band passes through hole 32*a* in cap 32 with its longitudinal axis parallel to the bottom rail 16. This maintains the edge position of the band near the bottom of the blind. Pressure or contact by the elongated edge of the hole in the slats maintains the edge of the band to the observer. When the band passes into the head rail 12 it will turn 90° approximately at the position indicated in FIG. 1 with 20*a* to wind flat evenly on the reel portion 28*a* of tape drum 28. The top edge 20*b* of the band 20 is held by a special barb element 72 (see FIGS. 12 and 13). It comprises three spaced prongs 74, 76 and 78. Prongs 74 and 78 are bent upwardly and prong 76 downwardly out of the plane of the material forming the barb element 72 and band edge 20*b* is clamped therebetween. Barb 72 is located within a slot 28*c* in drum 28 such that the prongs come to lie within the reel portion 28*b* and end 72*a* comes to rest within hub portion 28*a* between it and the approximately D-shaped tilt rod 26, as shown in dash-lines in FIG. 12. Adjacent reel portion 28*b* there is a section 28*d* for receiving a sled 80. Sled 80 is provided with two grooves 80*a* and 80*b* for receiving barbs 82 connected to the ends of ladders 18 which are passed through a hole (not shown) in sled 80. When the drum 28 is turned by the clutch mechanism 22 and tilt rod 26, sled 80 follows the movement of the drum due to friction and thereby tilts the slats 14. When the blind reaches the fully closed position the drum continues to turn and wind or unwind the band 20, whereas the sled 80 maintains its position for maximum closure of the blind.

Figure 18:
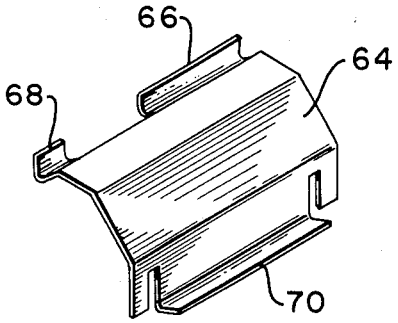
FIG. 18 is a perspective view of the lid to be placed over the tape drum of the venetian blind.
Figure 20:
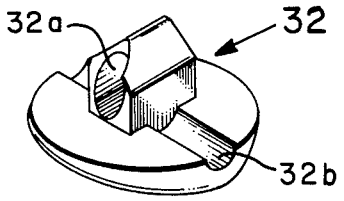
FIG. 20 is a perspective view of the ladder cap.
Figure 17:
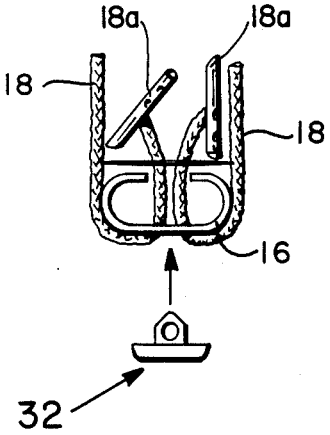
FIG. 17 is an end view of the bottom rail, with the ends of the ladders passed through the opening in the bottom rail and of a ladder cap to be inserted into the opening.
Figure 16:
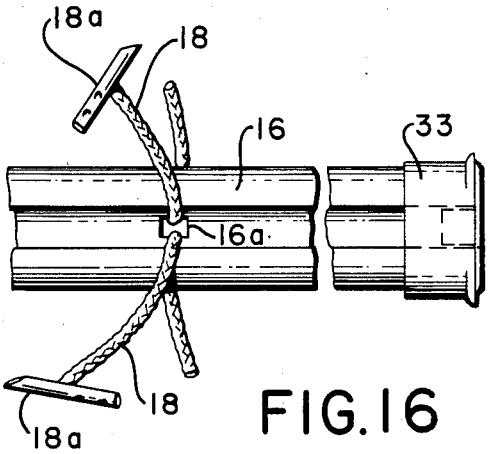
FIG. 16 is a top view of the bottom rail, including an end cap, and illustrates the passage of parts of the venetian blind ladder through an opening in the bottom rail.
Figure 19:
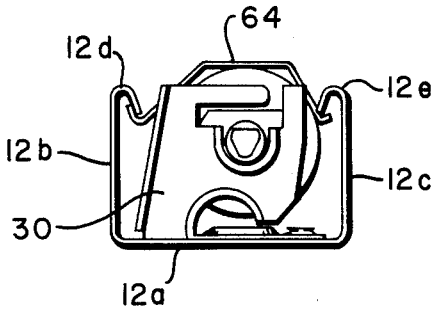
FIG. 19 is an end view of the tape drum and cover installed in the venetian blind head.
Figure 15:
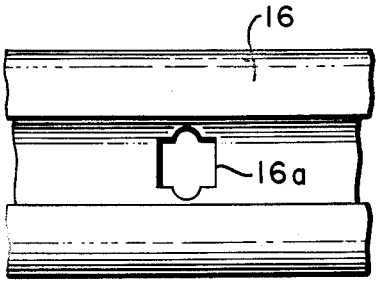
FIG. 15 is a partial top-view of the bottom rail.

A cover 64 (see FIG. 18) is placed over each cradle 30 and drum 28. Cover 64 is provided with bent up edges 66 and 68 on one side and 70 on the other. They fit respectively under flanges 12*d* and 12*e* of the front and rear wall 12*b* and 12*c* respectively of the head rail. When in place the cover holds the cradle 30 in the head rail, together with tabs 34 (FIGS. 3 and 4). This also holds housing 42 of the clutch mechanism indirectly in head rail 12 because the position of tilt rod 26 is fixed.

As has been mentioned before the tilt rod 26 is essentially D-shaped and therefore the hubs 28*a* of the drum 28 have a D-shaped passage for accommodating the tilt rod and for properly fixing the position of the drum thereon. The outer circumference of the hub 28*a*, however, is round. This is necessary to assure a smooth rotation of the drum in cradle bearings 30*a*.

We claim:

1. In a venetian blind: an elongated head rail; a plurality of parallel elongated slats below said head rail; an elongated bottom rail below said slats; a tilt rod rotatably mounted in said head rail; at least one pair of reel means mounted on said tilt rod for rotation therewith and in spaced relationship to each other; a clutch mechanism operatively connected to said tilt rod; means for engaging said clutch mechanism in one direction or the other to thereby rotate said tilt rod in one direction or the other; at least one pair of ladders extending respectively at locations below said pair of reel means, each ladder having a pair of side pieces of cord material and a plurality of rungs for respectively supporting said plurality of slats and having a bottom end connected to said bottom rail and a top end slidably received on the respective reel means; and at least one pair of lift tapes respectively at locations below said pair of reel means, each lift tape having a bottom end connected to the bottom end of the other lift tape, and a top end connected to the respective reel means; each lift tape being an extremely thin band having a wide side, and a narrow side narrower than the cord, each reel means including two disks axially spaced from each other a distance substantially corresponding to the wide side of the band, the respective band being wound onto or unwound from said reel means between said disks with the turns of the band neatly one on top of the other; each slat being provided with at least one pair of narrow slots respectively beneath said pair of reel means, each slot having its major extension transverse to the longitudinal extension of the respective slat and receiving therein the respective lift tape with the wide side thereof transverse to the longitudinal extension of the slat, and the narrow side thereof between the ladder side pieces and aligned therewith, and at least one pair of caps in said bottom rail at locations below said pair of reel means and respectively provided with openings for receiving therethrough the respective bottom end of the pair of lift tapes.

2. The combination of claim 1, wherein said clutch means has a housing, said housing having ledge means for fixing said housing in said head rail, a portion of said housing extending through an opening in said head rail, and forming means for guiding said operating means for said clutch mechanism.

3. The combination of claim 1, wherein said clutch mechanism includes a pulley with circumferentially spaced protrusions, and said clutch mechanism operating means is a cord placed around a portion of the circumference of said pulley and having spaced beads for respective engagement with said protrusions.

4. The combination of claim 1, wherein said bottom ends of said tapes are connected to each other by a knot.

5. The combination of claim 1, comprising at least one sleeve with a through opening, the bottom ends of said lift tapes respectively being provided with barbs wider than said opening, the bottom end of one lift tape being passed through said opening from one side and with its barb on the other, the bottom end of the other lift tape being passed through said opening from the other side and with its barb on the one side.

6. The combination of claim 1, comprising means for connecting the top end of the respective lift tape to the respective reel means, said lift tape connecting means comprising barb means having one end for connection to the respective reel means and another end with fork-like prongs for receiving the respective lift tape top end therebetween.

7. The combination of claim 1, comprising means for slidably connecting the top end of the respective ladder to the respective reel means, said ladder connecting means comprising sled means slidably received on a circumferential surface of the respective reel means, said top ends having barbs connected to said sled means.

* * * * *